US006315701B1

(12) United States Patent
Shifferaw

(10) Patent No.: US 6,315,701 B1
(45) Date of Patent: Nov. 13, 2001

(54) PORTABLE EXERCISE MACHINE

(76) Inventor: Tessema Dosho Shifferaw, P.O. Box 70625, Point Richmond, CA (US) 94807

( * ) Notice: Subject to any disclaimer, the term of this patent is extended or adjusted under 35 U.S.C. 154(b) by 0 days.

(21) Appl. No.: 09/196,714

(22) Filed: Nov. 20, 1998

(51) Int. Cl.[7] ..... A63B 21/012

(52) U.S. Cl. ..... 482/114; 482/110; 482/116; 482/120

(58) Field of Search ..... 482/114, 83, 74, 482/120, 123, 126, 116, 127, 129, 908, 115, 82, 72, 121, 124

(56) References Cited

U.S. PATENT DOCUMENTS

| | | | | |
|---|---|---|---|---|
| 2,128,332 | | 8/1938 | Schollmeyer | 272/72 |
| 2,821,394 | | 1/1958 | Barbeau | 272/140 |
| 3,764,132 | | 10/1973 | Hepburn | 272/140 |
| 3,785,644 | | 1/1974 | Bradley et al. | 272/140 |
| 4,077,626 | | 3/1978 | Newman | 272/140 |
| 4,257,592 | | 3/1981 | Jones | 272/140 |
| 4,645,204 | | 2/1987 | Berger | 272/140 |
| 4,659,077 | * | 4/1987 | Stropkay | 272/97 |
| 4,728,103 | | 3/1988 | Fulton | 272/140 |
| 4,944,511 | * | 7/1990 | Franscis | 272/137 |
| 5,429,563 | * | 7/1995 | Engel et al. | 482/54 |
| 5,496,236 | * | 3/1996 | Buonauito | 482/57 |
| 5,876,310 | * | 3/1999 | Mackey et al. | 482/74 |

* cited by examiner

*Primary Examiner*—Mickey Yu
*Assistant Examiner*—Tam Nguyen
(74) *Attorney, Agent, or Firm*—Flehr Hohbach Test Albritton & Herbert LLP

(57) ABSTRACT

Portable exercise machine having a base, a capstan rotatively mounted within the base, an elongated cable wrapped about the capstan and trained about guides toward opposite ends of the base with end portions of the cable extending beyond the base, handles attached to the end portions of the cable for drawing the cable back and forth through the base and thereby rotating the capstan, and means for resisting rotation of the capstan. The handles have frames with reels rotatively mounted on the frames and the end portions of the cable being wound about the reels, springs for rotating the reels to wind the end portions of the cable onto the reels, first grips connected to the reels and adapted to be grasped by the hands of an exerciser to prevent rotation of the reels and second grips connected to the frames and adapted to be engaged by the hands of the exerciser for moving thee handles without inhibiting rotation of the reels.

22 Claims, 8 Drawing Sheets

PORTABLE EXERCISE MACHINE

This invention pertains generally to exercise equipment and, more particularly, to a portable exercise machine.

In recent years, with the emphasis which has been placed on the importance of physical fitness and body development, a number of different types of exercise machines have been provided.

U.S. Pat. No. 4,944,511, for example, discloses a portable exercise device in which cords equipped with hand grips are wrapped about reels in a housing on which the exerciser stands. Unwinding of the cords from the reels is resisted by spring packs which are mounted to the reels and can be stacked to increase the resistance.

U.S. Pat. No. 4,077,626 discloses an exercise machine in lines pulled by the exerciser are coupled to a flywheel through a ratcheting transmission so that pulling on the lines causes the flywheel to spin. When the pull stops, the lines are retracted by spring-loaded spools on the input shaft of the transmission.

U.S. Pat. No. 4,645,204 shows a portable exercise device having an elongated elastic cable folded back and forth between pulleys at opposite ends of a housing, with hand grips or handles connected to the end portions of the cable outside the housing. Pulling on the cable causes the cable to stretch throughout its entire length, including the portion folded about the pulleys, thereby providing substantially greater elongation and handle movement than would be possible with a shorter cable.

U.S. Pat. No. 4,257,592 shows an exercise device having handles connected to the ends of a rope which is trained about pulleys at opposite ends of a housing on which the exerciser stands. The effective length of the rope is adjusted by forming a loop in the rope and securing it with a clamp. The only resistance provided by this device is the pull of one arm against the other.

Other types of machines which are currently available (e.g. treadmills, stair steppers, cycles, rowing machines, and riders) tend to be expensive and to require a relatively large, dedicated floor area for use.

It is in general an object of the invention to provide a new and improved exercise machine.

Another object of the invention is to provide an exercise machine of the above character which overcomes the limitations and disadvantages of machines heretofore provided.

Another object of the invention is to provide an exercise machine of the above character which is highly portable and does not require a large floor area for use.

Another object of the invention is to provide an exercise machine of the above character which is economical to manufacture and to own.

Another object of the invention is to provide an exercise machine of the above character which can be used for a wide variety of different exercises.

These and other objects are achieved in accordance with the invention by providing a portable exercise machine having a base, a capstan rotatively mounted within the base, an elongated cable wrapped about the capstan and trained about guides toward opposite ends of the base with end portions of the cable extending beyond the base, handles attached to the end portions of the cable for drawing the cable back and forth through the base and thereby rotating the capstan, and means for resisting rotation of the capstan. The handles have frames with reels rotatively mounted on the frames and the end portions of the cable being wound about the reels, springs for rotating the reels to wind the end portions of the cable onto the reels, first grips connected to the reels and adapted to be grasped by the hands of an exerciser to prevent rotation of the reels and second grips connected to the frames and adapted to be engaged by the hands of the exerciser for moving the handles without inhibiting rotation of the reels.

Figure 1:
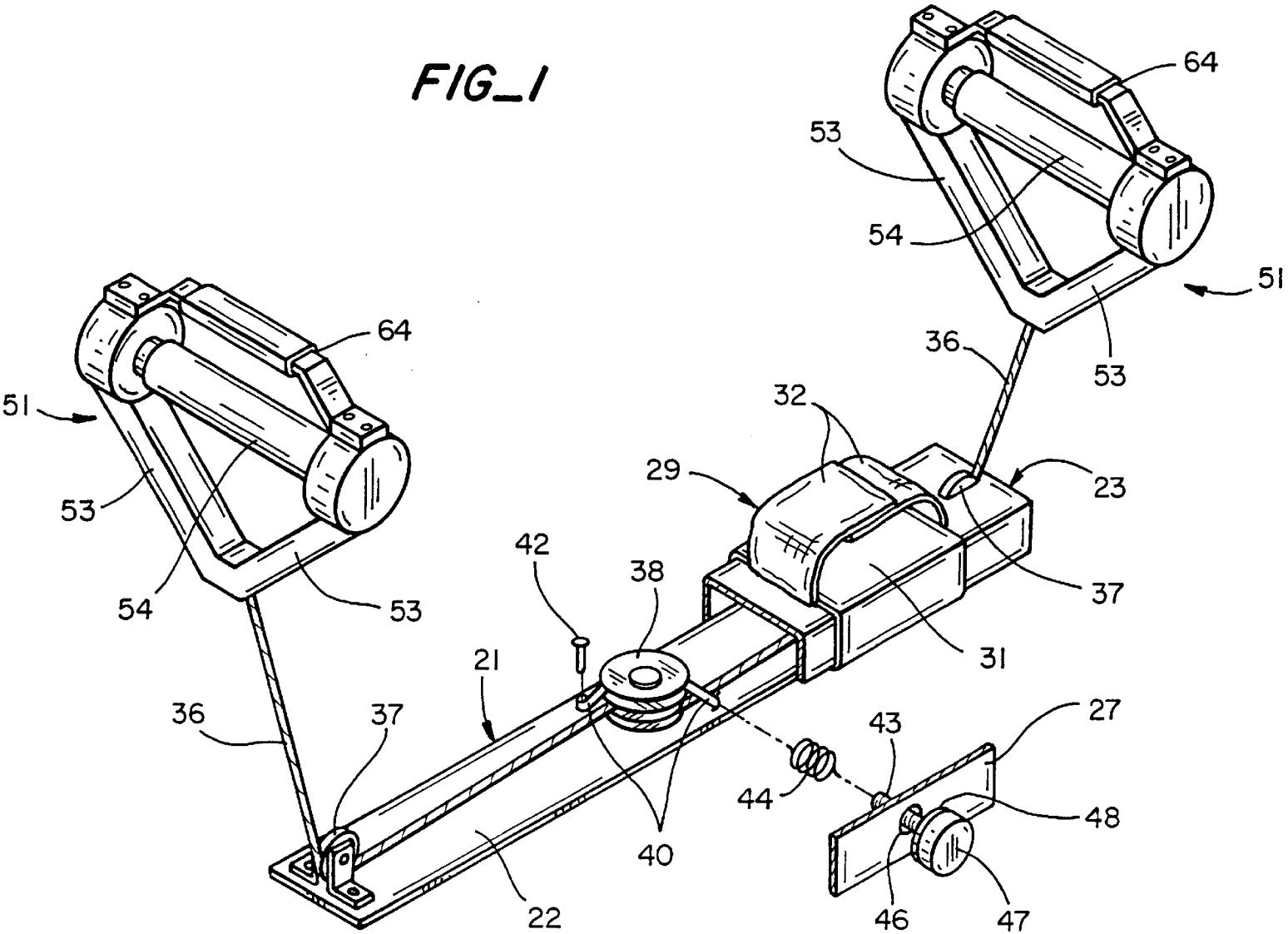
FIG. 1 is an isometric view, partly broken away and partly exploded, of one embodiment of a portable exercise machine according to the invention.
Figure 2:
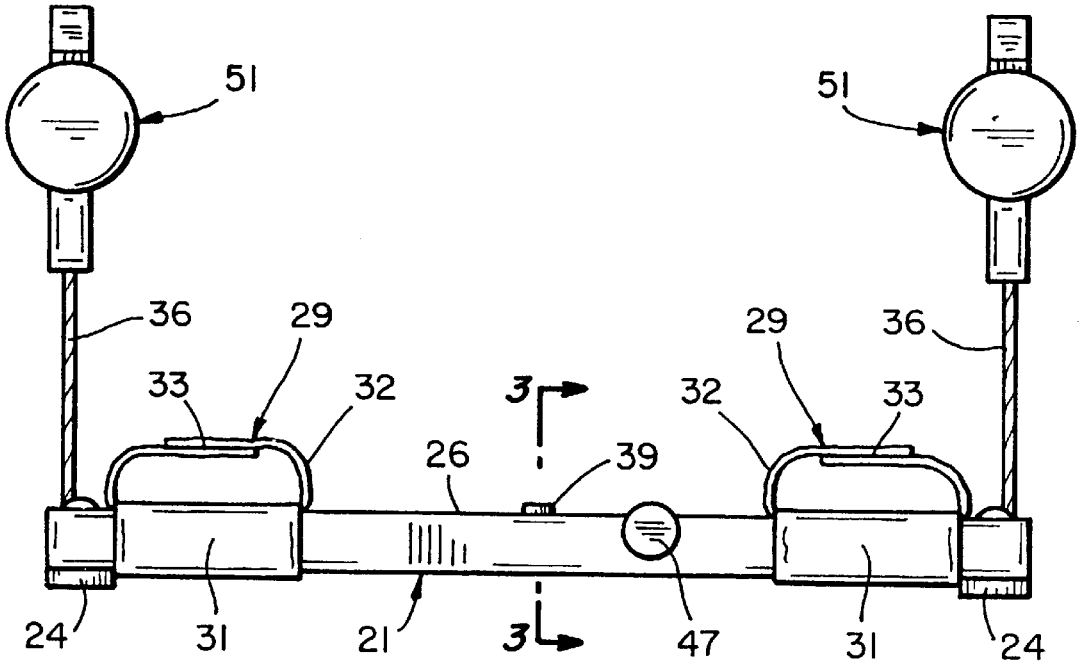
FIG. 2 is a side elevational view of the embodiment of FIG. 1.
Figure 3:
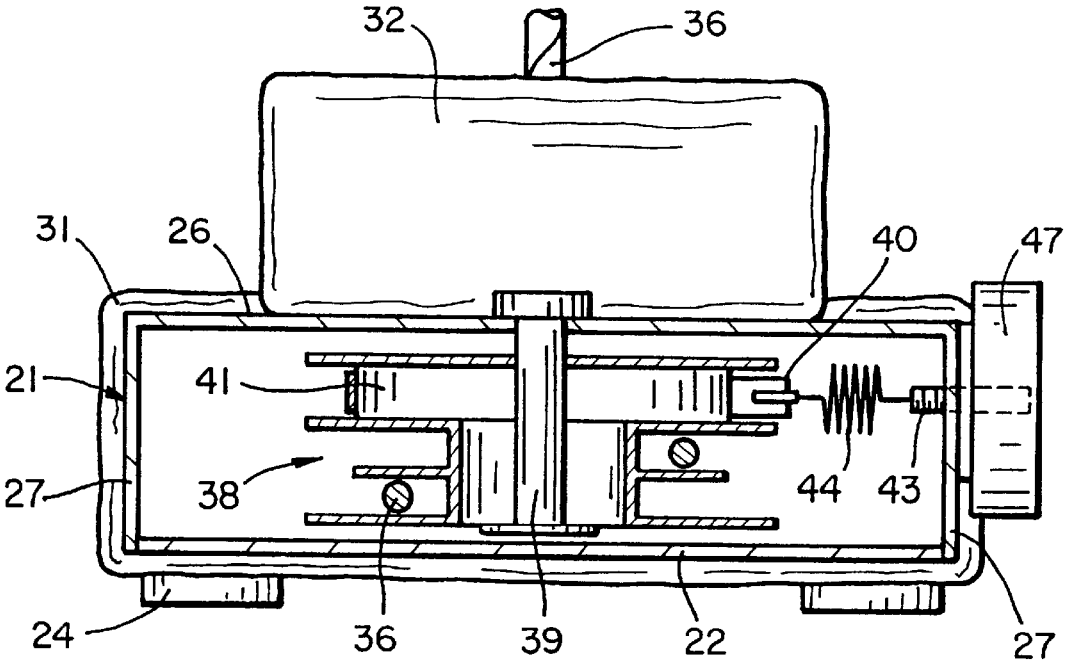
FIG. 3 is a cross-sectional view taken along line 3—3 in FIG. 2.
Figure 4:
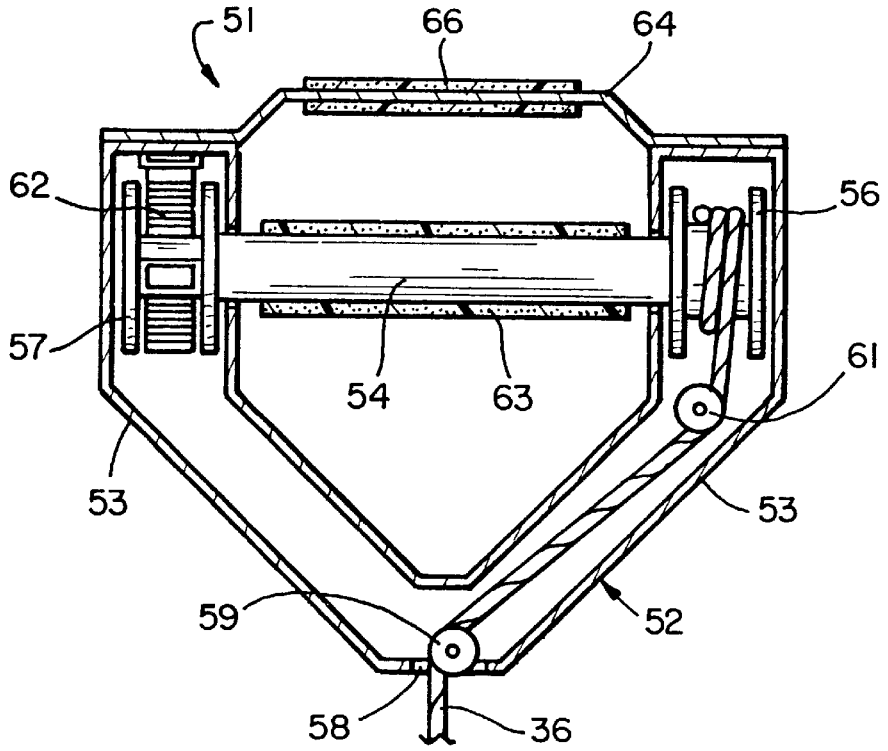
FIG. 4 is a cross-sectional view of one of the handles in the embodiment of FIG. 1.

As illustrated in FIG. 1, the exercise machine includes an elongated base 21 which is adapted to receive the feet of a person using the machine. The base has a lower section 22 and an upper section or cover 23, with mounting feet 24 are on the under side of the lower section. The upper section or cover has a generally U-shaped cross-section, with a top wall 26 and depending side walls 27. the upper section is secured to the lower section by suitable means such as screws, not shown.

Foot holders 29 are mounted on the base toward the ends thereof. Each of the foot holders includes a resilient pad 31 which wraps about the top and side walls of the base and is adapted to have the bottom of the exerciser's foot rest thereon. Each foot holder also includes a pair of straps 32 which wrap over the top of the foot to hold the foot in place. The two straps are connected together to form a loop, with a hook and pile fastener 33 permitting the size of the loop to be adjusted to accommodate feet of different sizes.

A flexible cable 36 is trained about guide pulleys 37 toward the ends of the base and wrapped about a capstan 38 inside the base, with end portions of the cable extending outside the base. The capstan is rotatively mounted on a spindle 39 which is affixed to cover 23 for rotation about an axis perpendicular to the longitudinal axis of the base. In the embodiment illustrated, the cable is formed in two sections, each of which is affixed to the capstan at its inner end. The two sections are wrapped about the capstan in opposite directions so that pulling on either section tends to rotate the capstan in a direction which causes the other section to be wrapped about it. Thus, by pulling on the free ends of the cable, a person can draw the cable back and forth through the base.

Alternatively, if desired, the cable can have a single section which is wrapped about the capstan, in which case the cable can either be attached to the capstan or simply wrapped about it, with friction providing a driving connection between the two.

Means is provided for resisting rotation of the capstan. In the embodiment illustrated, this means comprises a brake band 40 which is wrapped partially around a brake drum 41 on the capstan. One end of the band is affixed to the base by a pin 42, and the other end is connected to a drawbolt 43 by a spring 44. The drawbolt extends through an opening 46 in a side wall of the base, and a nut or knob 47 is threadedly mounted on the outer portion of the drawbolt, with a washer 48 between the knob and the outer surface of the wall. When the knob is turned in one direction, it bears against the wall and draws the bolt in an outward direction, thereby tightening the band about the drum and increasing the resistance to rotation of the capstan. When the knob is turned in the other direction, the spring pulls the bolt in an inward direction, thereby relaxing band on the drum and reducing resistance to rotation.

The drawbolt is constrained against rotation by its connection to the brake band. If further constraint is desired, the drawbolt can be formed with a noncircular cross-section (e.g. a flat side) where it passes through the opening in the base, and the opening can have a corresponding shape.

Handles 51 are connected to the free ends of the cable and are adapted to be grasped by the hands of a person using the machine. The handles are provided with retracting mechanisms which wind up the end portions of the cables when the machine is not in use.

Each of the handles has a generally V-shaped frame 52 with a pair of side arms 53 and a shaft 54 rotatively mounted between the side arms. The frame is hollow, and reels 56, 57 are affixed to the ends of the shaft inside the arms. The end portion of cable 36 enters the handle through an opening 58 at the apex of the V, is trained about guide rollers 59, 61, and is wound onto reel 56. A clock spring 62 is wound about reel 57 and connected to the frame for rotating the shaft to wind the cable onto reel 56.

A rubber grip 63 is mounted on the central portion of shaft 54, and a crossbar 64 extends between the outer ends of arms 53 in spaced parallel relation to the shaft. A rubber grip 66 is mounted on the crossbar.

Figure 5A:
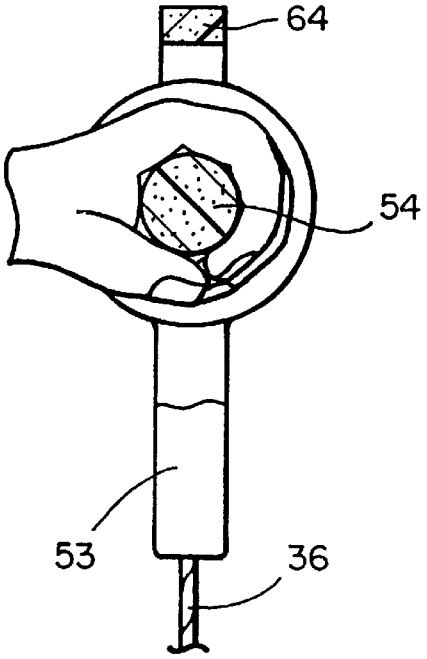
FIGS. 5A and 5B are operational views of the handle of FIG. 4.
Figure 5B:
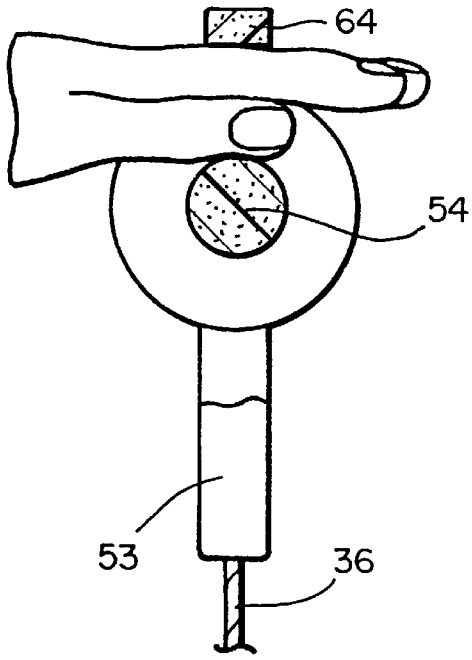

The exerciser can slip his hand between crossbar 64 and shaft 54, and wrap his fingers and thumb around the shaft as illustrated in FIG. 5A. As long as he grips the shaft, it cannot rotate, and the handle is thereby affixed to the cable. When he relaxes his grip, spring 62 turns the shaft and winds the cable onto reel 56. To draw more cable from the reel, the exerciser can simply release the shaft and push against crossbar 64 with the back of his hand, as illustrated in FIG. 5B.

To use the machine, the exerciser places his feet in foot holders 29, then pulls on some portion of the handles other than the shaft to extend the cable. When he has the amount of cable he wants, he grasps the shaft and proceeds with his exercise.

As the exerciser pulls the cable back and forth through the base, the cable winds onto and off of capstan 38, thereby rotating the capstan. Movement of the cable is resisted by frictional engagement of brake band 40 with brake drum 41, with the amount of resistance being adjusted by turning knob 47 on drawbolt 43.

Figure 6:
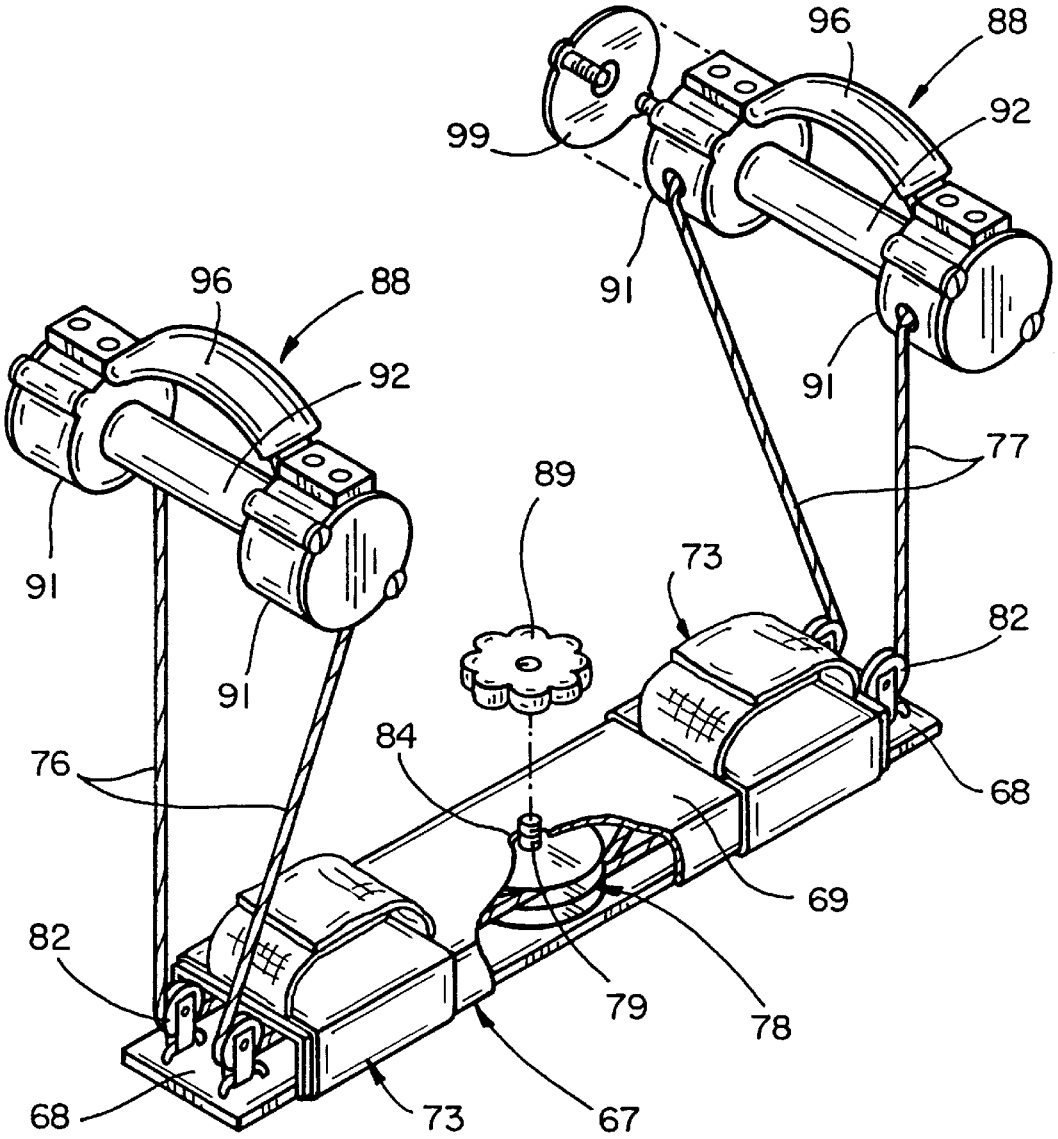
FIG. 6 is an isometric view, partly broken away and partly exploded, of another embodiment of a portable exercise machine according to the invention.
Figure 9:
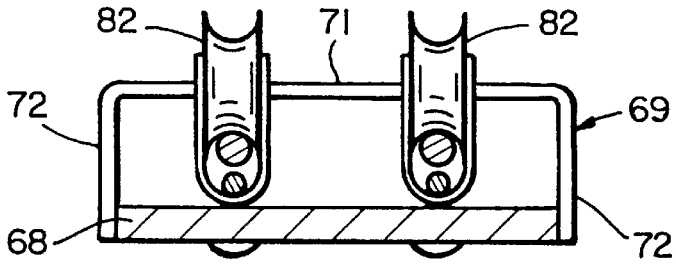
FIG. 9 is a cross-sectional view taken along line 9—9 in FIG. 7.
Figure 7:
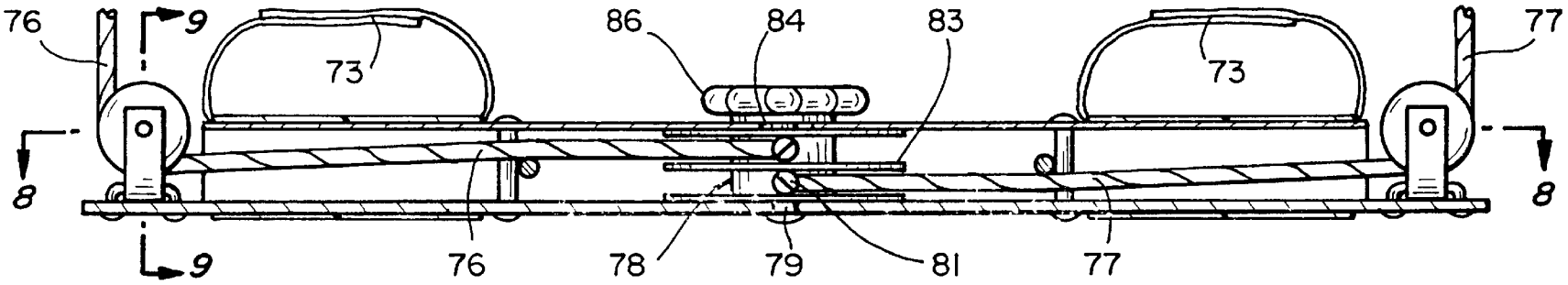
FIG. 7 is a vertical sectional view of the embodiment of FIG. 6.
Figure 8:
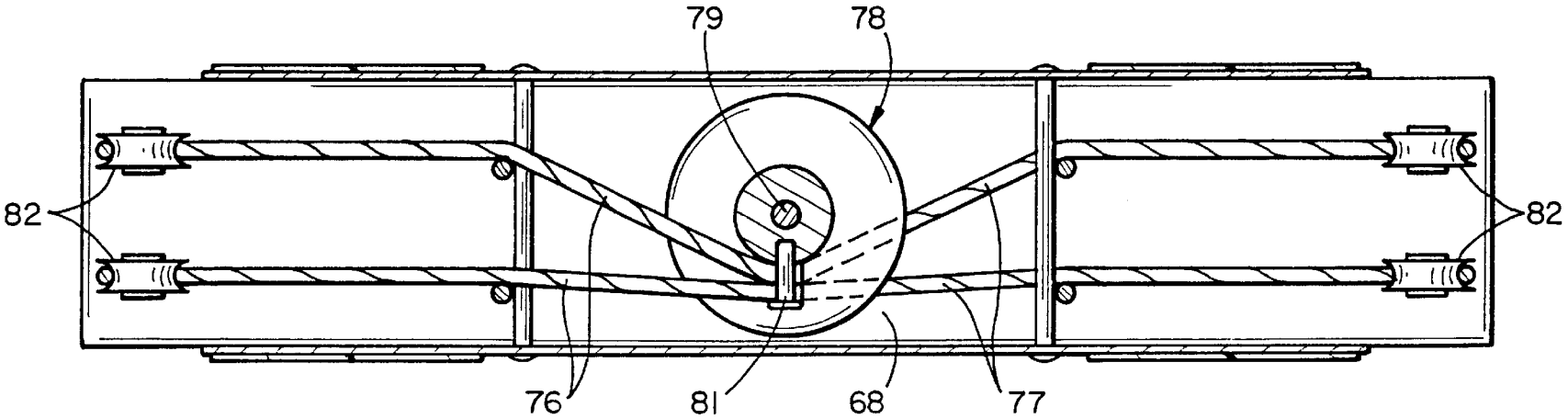
FIG. 8 is a cross-sectional view taken along line 8—8 in FIG. 7.
Figure 10:
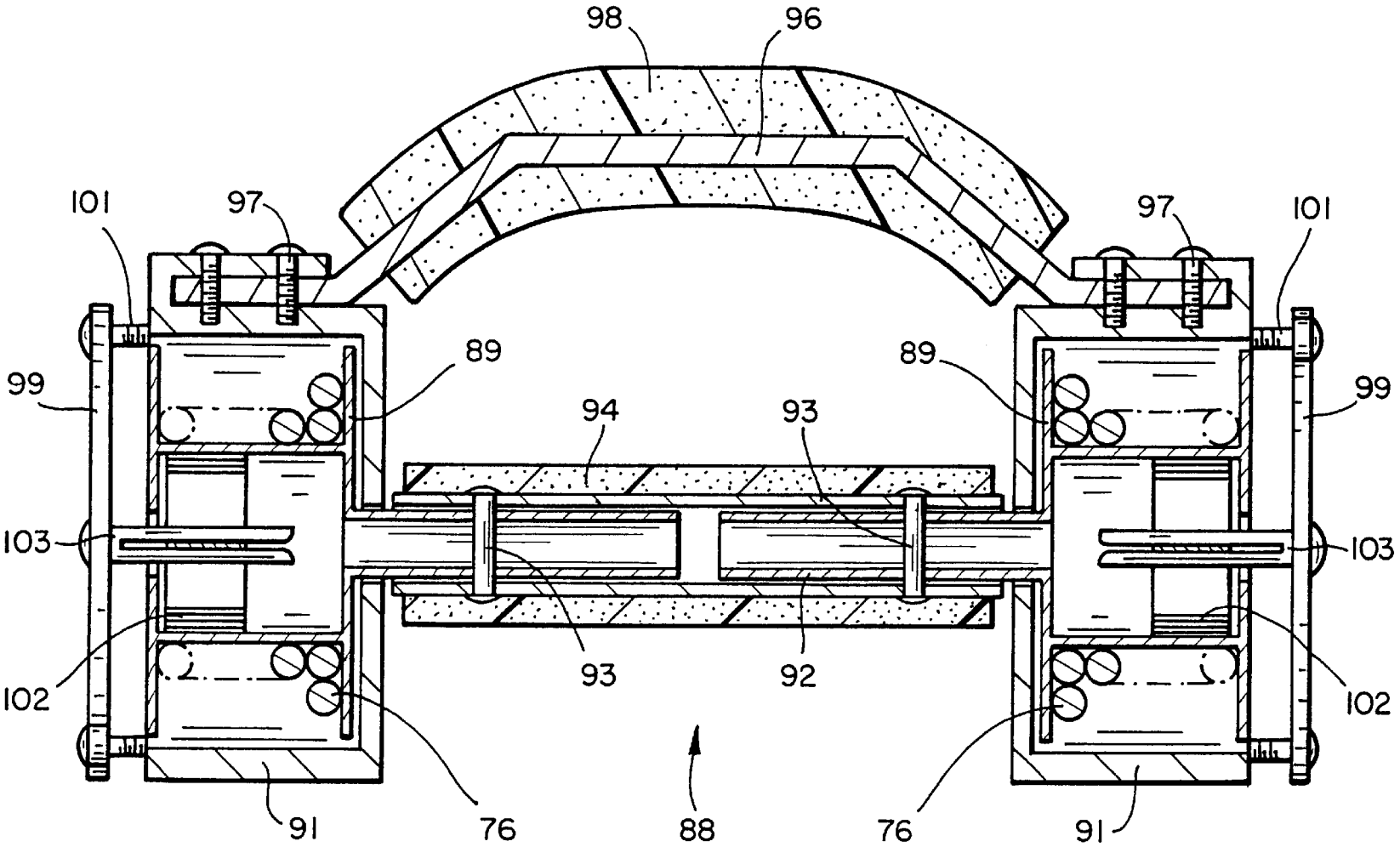
FIG. 10 is a cross-sectional view of one of the handles in the embodiment of FIG. 6.

The embodiment of FIG. 6 is generally similar to the embodiment of FIG. 1 except that it has double cables connected to the hand grips and a different braking mechanism.

This embodiment has an elongated base 67 with a lower section 68 and an upper section or cover 69. The cover section has a generally U-shaped cross-section with a top wall 71 and depending side walls 72. Foot holders 73 similar to foot holders 29 are located toward the ends of the base Two double cables 76, 77 are wound in opposite directions about a capstan 78 which is rotatively mounted on a vertically extending spindle 79 in base 67. The cables are affixed to the hub of the capstan by pins 81, and are trained about pulleys 82 at the ends of the base. In this particular embodiment, the capstan is formed in two sections which are separated by a flange 83, with cable 76 being wrapped about the upper section and cable 77 being wrapped about the lower section.

The upper end of spindle 79 passes through an opening 84 in the top wall of the base, and a handwheel or nut 86 is threadedly mounted on the spindle on the upper side of the top wall. In the embodiment illustrated, the spindle is in the form of a carriage bolt which also passes through the bottom wall of the base, with the square shoulder at the base of the head being received in a square opening in the bottom wall to prevent the bolt from turning.

In this embodiment, rotation of the capstan is resisted by frictional between the axial faces of the capstan and the walls of the base. When the handwheel is turned in one direction, the walls are drawn together, and the resistance increases. When it is turned in the other direction, the walls relax and the resistance decreases. If desired, washers (not shown) can be employed at the ends of the capstan and under the handwheel.

The free ends of cables 76, 77 are connected to handles 88 each of which has a pair of reels 89 about which the end portions of the respective cable are wrapped. The two reels are rotatively mounted in end housings 91 and affixed to opposite ends of a tubular shaft 92 by rivets 93. A rubber grip 94 is mounted on the shaft between the housings, and a crossbar 96 extends between the housings in spaced parallel relation to the shaft. The crossbar is affixed to the two housings by suitable means such as screws 97 to form a rigid frame structure, and a rubber grip 98 is mounted on the crossbar.

End caps 99 are affixed to the housings by screws 101, and clock springs 102 are mounted inside the reels to rotate them relative to the frame formed by crossbar 96 and the two housings. The outer ends of the springs are attached to the reels, and the inner ends are received in slotted pins 103 which are affixed to the end caps.

Operation and use of this embodiment is similar to that previously described in connection with the embodiment of FIG. 1. The exerciser places his feet in foot holders 73 and grips crossbars 96 to withdraw the cable from the handles. When he has the amount of cable he wants, he grasps shafts 92 and proceeds with his exercise.

As the cables are drawn back and forth relative to the base, they are wound onto and off of capstan 78, rotating the capstan about spindle 79. Rotation of the capstan is resisted by frictional engagement with the end faces of the capstan, and the amount of resistance can be adjusted by turning handwheel 86 on the spindle. When the handles are released, the cables are retracted into them as in the previous embodiment.

The machine can be employed in performing a variety of different exercises, some of which are shown in FIGS. 11–18. In each of these, both positive and negative resistances are applied to the muscles involved, and the amount of resistance can be adjusted as desired.

Figure 11:
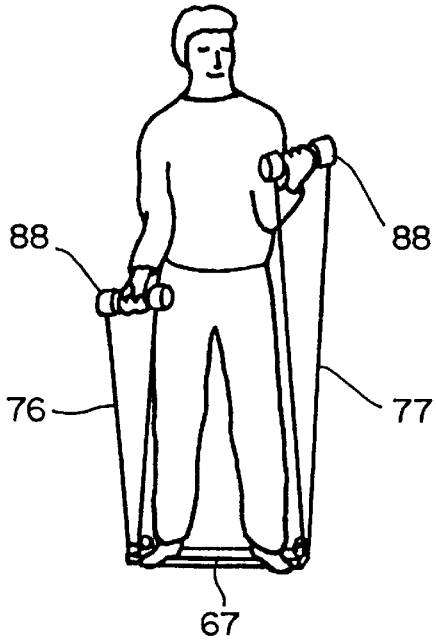
FIGS. 11–18 are operational views showing the use of the embodiment of FIG. 6 in performing a number of different exercises.

In FIG. 11, the exerciser is standing on the base, holding the handles from beneath, and doing biceps curls to develop, strengthen and stretch the biceps and the forearms, the front upper part of the arm and the lower portion of the arm. In this same position, the machine can be used to exercise the forearm and to do wrist curls.

Figure 12:
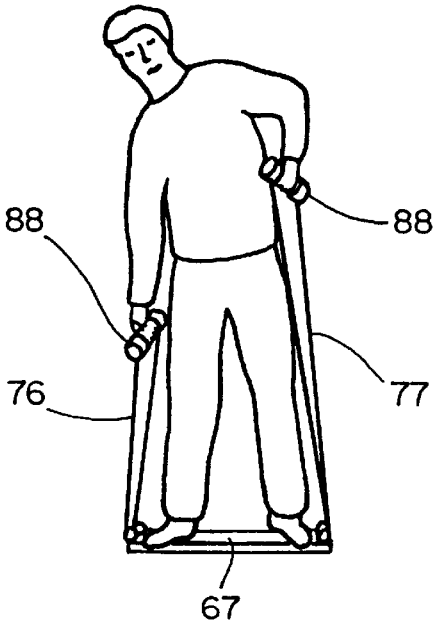

In FIG. 12, the exerciser is once again standing on the base, doing side bends which firm and strengthen the stomach and the sides of the stomach.

Figure 13:
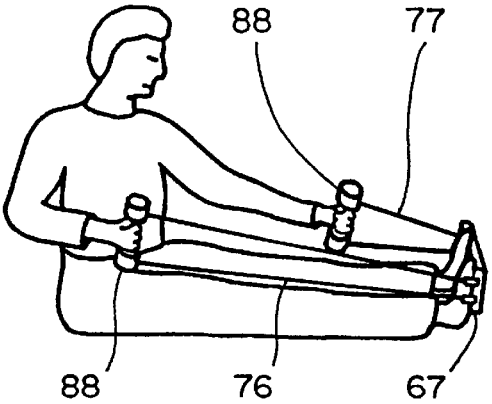

In FIG. 13, the exerciser is doing a seated rowing exercise in which he is sitting on the floor with his legs extended and his feet pressing against the base of the machine. With no braking force applied to the capstan, the resistance is provided by the exerciser's own muscles, and he can exercise back, arm and stomach muscles. By adding light resistance and moving faster, the exerciser can do aerobic, fat burning and cardiovascular exercises as well.

Figure 14:
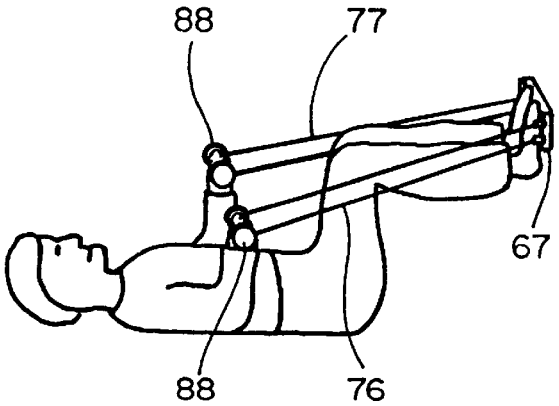

In FIG. 14, the exerciser is lying on his back, with his knees bent, pushing against the base with both feet and pulling on the cables with both arms. With the arms working against the legs in this manner, the shoulders and abdominal muscles are exercised as well as the arms and the legs.

Figure 15:
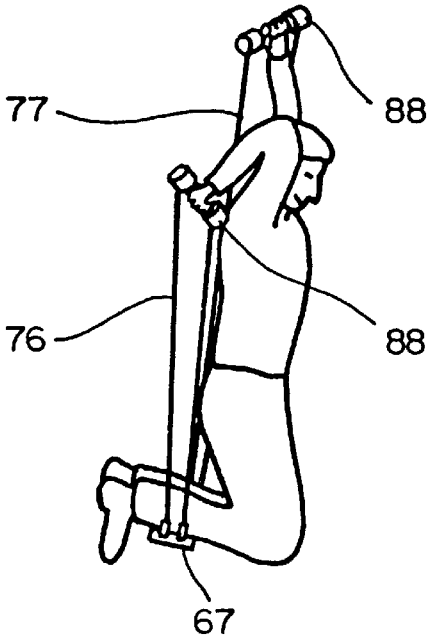

FIG. 15 shows the exerciser in a kneeling position, with the base of the machine beneath his shins, the cables behind his back, and his hands gripping the handles from above. By extending one arm and resisting with the other, he exercises both the triceps and the backs of the upper arms.

Figure 16:
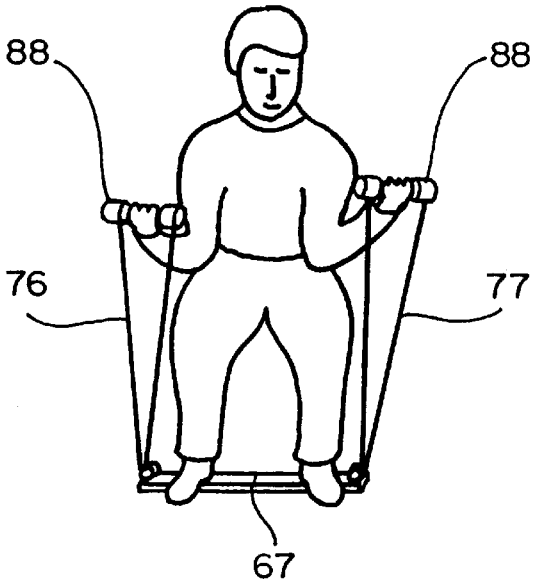

In FIG. 16, the exerciser is doing a squat exercise in which he stands on the base in a squatting position and pulls with his arms to add to the force which the legs encounter as goes up and down.

Figure 17:
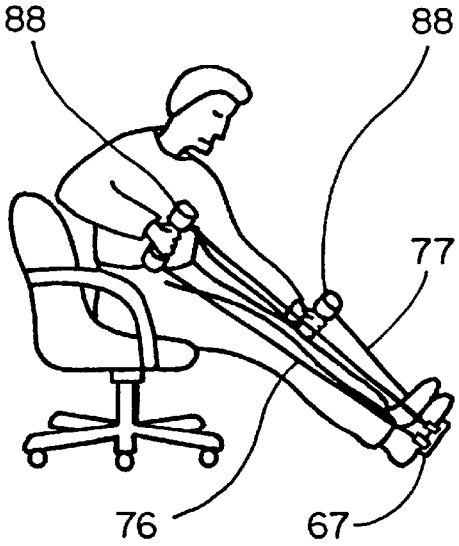

In FIG. 17, the exerciser is sitting in a chair, doing a rowing exercise. He can also do wrist curls in a similar sitting position, with one arm resisting movement of the other.

Figure 18:
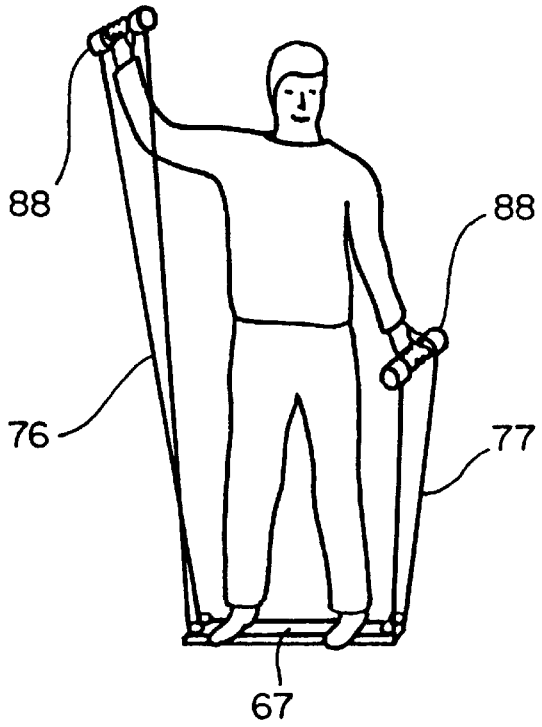

In FIG. 18, the exerciser is standing on the base, doing shoulder raises which exercise and develop the shoulders and the back of the neck.

It is apparent from the foregoing that a new and improved portable exercise machine has been provided. While only certain presently preferred embodiments have been described in detail, as will be apparent to those familiar with the art, certain changes and modifications can be made without departing from the scope of the invention as defined by the following claims.

What is claimed is:

1. An exercise machine comprising a base, a single capstan rotatively mounted within the base, an elongated cable wrapped about the single capstan and trained about guides toward opposite ends of the base with end portions of the cable extending outside the base, handles attached to the end portions of the cable for drawing the cable back and forth through the base and thereby rotating the capstan, the handles including reels on which the end portions of the cable are wound and means for rotating the reels to wind the cable onto the reels, and means for resisting rotation of the capstan.

2. The exercise machine of claim 1 wherein the cable is formed in two sections which are wrapped about the capstan in opposite directions so that one section is wound onto the capstan and thereby shortened as the other section is withdrawn from the capstan.

3. The exercise machine of claim 1 including a second cable wrapped about the capstan and attached to the handles in parallel with the first named cable.

4. The exercise machine of claim 1 wherein the means for resisting rotation of the capstan comprises a brake band which frictionally engages a peripheral portion of the capstan.

5. The exercise machine of claim 1 wherein the capstan is rotatively mounted on a spindle inside the base, and the means for resisting rotation of the capstan comprises a handwheel threadedly mounted on the spindle and accessible externally of the base for drawing an axial face of the capstan into frictional engagement with a braking surface.

6. The exercise machine of claim 1 including straps mounted on the base for receiving the feet of a person using the machine.

7. An exercise machine comprising a base, a pair of guide pulleys rotatively mounted on the base, a cable trained about the guide pulleys for movement back and forth relative to the base with end portions of the cable projecting beyond the base, handles having reels on which the end portions of the cable are wound, springs for rotating the reels to wind the end portions of the cable onto the reels, first grips connected to the reels and adapted to be grasped by the hands of an exerciser to prevent rotation of the reels, and second grips which are not connected to the reels and are adapted to be engaged by the hands of the exerciser for moving the handles while leaving the reels free to rotate for winding and unwinding of the cable.

8. The exercise machine of claim 7 further including a second cable trained about guide pulleys on, the base and wrapped about reels in the handles in parallel with the first named cable.

9. The exercise machine of claim 7 wherein the cable is wrapped about a capstan which is rotatively mounted in the base, with means for resisting rotation of the capstan.

10. The exercise machine of claim 9 wherein the cable is formed in two sections which are wrapped about the capstan in opposite directions so that one section is wound onto the capstan and thereby shortened as the other section is withdrawn from the capstan.

11. An exercise machine comprising a base, a pair of guide pulleys rotatively mounted on the base, a cable trained about the guide pulleys for movement back and forth relative to the base with end portions of the cable projecting beyond the base, and handles connected to the end portions of the cable, each of the handles having a frame with opposing side members, a shaft rotatively mounted between the side members, a reel affixed to a first end portion of the shaft, with an end portion of the cable being wrapped about the reel, a spring connected to a second end portion of the shaft for rotating the reel to wind the end portion of the cable onto the reel, a first grip wrapped about a central portion of the shaft and adapted to be grasped by the hand of an exerciser to prevent rotation of the reel, and a second grip extending between the side members in parallel spaced relation to the first grip and adapted to be engaged by the hand of the exerciser for moving the handle while leaving the reels free to rotate for winding and unwinding of the cable.

12. The exercise machine of claim 11 wherein the spring is disposed coaxially about the second end portion of the shaft.

13. An exercise machine comprising an elongated horizontally extending base, a pair of guide pulleys rotatively mounted on the base toward opposite ends thereof, a capstan mounted within the base for rotation about an axis, an elongated cable wrapped about the capstan and trained about the guide pulleys with end portions of the cable extending outside the base, handles having reels on which the end portions of the cable are wound for drawing the cable back and forth through the base and thereby rotating the capstan, means for resisting rotation of the capstan, springs connected to the reels for rotating the reels to wind the end portions of the cable onto the reels to shorten the length of the cable between the handles, and means engagable by the hands of an exerciser for preventing rotation of the reels while pulling on the cable.

14. The exercise machine of claim 13 wherein the cable is formed in two sections which are wrapped about the capstan in opposite directions so that one section is wound onto the capstan and thereby shortened as the other section is withdrawn from the capstan.

15. The exercise machine of claim 13 wherein the means for resisting rotation of the capstan comprises a brake band which frictionally engages a peripheral portion of the capstan.

16. The exercise machine of claim 15 including means connected to the brake band and operable externally of the base for tightening the band about the capstan to increase resistance to rotation of the capstan.

17. The exercise machine of claim 16 wherein the means for tightening the band comprises a drawbolt having a first end connected to one end of the band and a second end which extends through a wall of the base, and a knob which is threadedly mounted on the second end and bears against the outside of the wall for drawing for drawing the band into engagement with the capstan.

18. The exercise machine of claim 17 wherein the drawbolt is connected to the band by a spring which draws the band against the capstan.

19. The exercise machine of claim 13 wherein the caps tan is rotatively mounted on a spindle having a threaded end portion which extends through a wall of the base, and the means for resisting rotation of the capstan comprises a handwheel threadedly mounted on the spindle outside the base for tightening the capstan against the wall to resist rotation of the capstan.

20. The exercise machine of claim 13 further including foot holders mounted on the upper side of the base toward the opposite ends.

21. The exercise machine of claim 20 wherein each of the foot holders comprises a pad which receives the bottom of the foot, and a strap which wraps across the top of the foot.

22. The exercise machine of claim 21 wherein the strap is formed in two sections with a hook and pile fastener for holding the two sections together.

* * * * *